United States Patent [19]

Glode

[11] Patent Number: 4,662,127

[45] Date of Patent: May 5, 1987

[54] AEROSTATIC ROOF

[76] Inventor: Laurent Glode, 113 Thivierge Street, Ste-Foy, Quebec, Canada, G2G 1E9

[21] Appl. No.: 234,200

[22] Filed: Feb. 11, 1981

[30] Foreign Application Priority Data

Oct. 29, 1980 [CA] Canada ..... 363522

[51] Int. Cl.[4] ..... E04B 1/34

[52] U.S. Cl. ..... 52/2

[58] Field of Search ..... 52/2, 66; 244/24, 125, 244/126, 128

[56] References Cited

U.S. PATENT DOCUMENTS

| | | | |
|---|---|---|---|
| 2,411,316 | 11/1946 | Capita | 52/2 |
| 2,850,026 | 9/1958 | Leatherman | 52/2 |
| 3,129,911 | 4/1964 | Fitzpatrick | 244/125 |
| 3,999,333 | 12/1976 | Amarantos | 52/2 |
| 4,257,199 | 3/1981 | Kuboyama | 52/2 |

*Primary Examiner*—Carl D. Friedman

[57] ABSTRACT

A self supporting, mobile, removable roof for building structures including a plurality of helium filled balloons within a shell. Propulsion means and piloting cabin are provided.

1 Claim, 6 Drawing Figures

AEROSTATIC ROOF

DETAILED DESCRIPTION

In drawings which illustrate embodiments of the invention,

The illustrated roof, comprises briefly the study of its structure and specially the location of its constituent elements.

Figure 1:
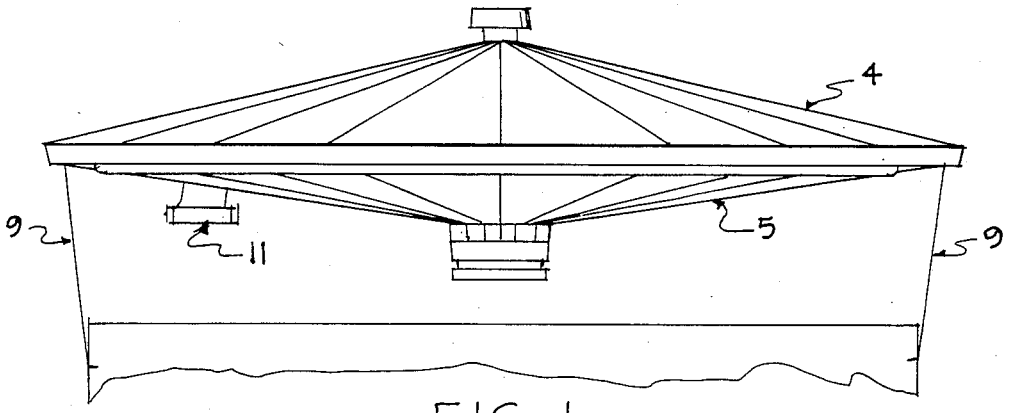
FIG. 1 is a side elevation view of the roof from point B on FIG. 2 illustrating open roof, and mooring to the building.
Figure 2:
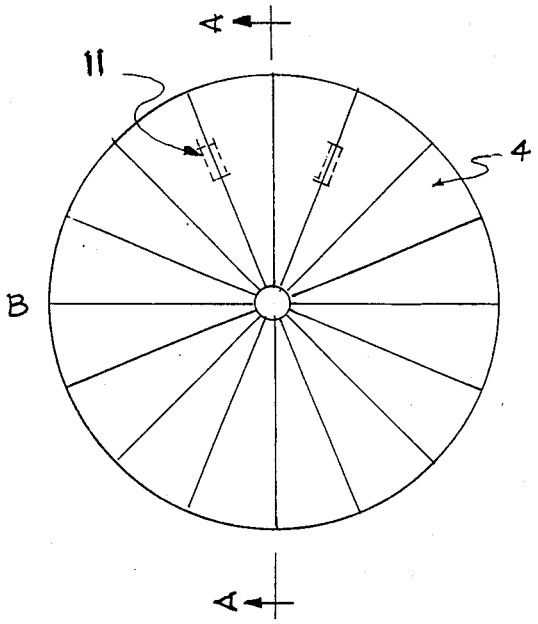
FIG. 2 is a circular plan view showing the motors and position of the trusses from the core.
Figure 3:
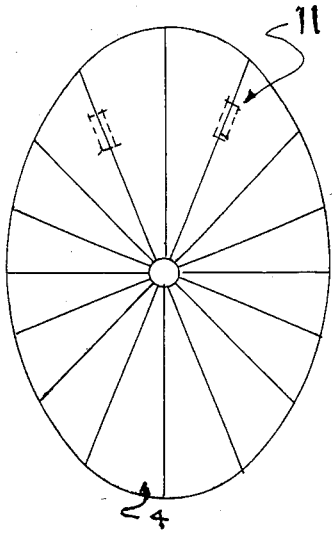
FIG. 3 is an elliptical plan view showing the motors and position of the trusses from the core.
Figure 4:
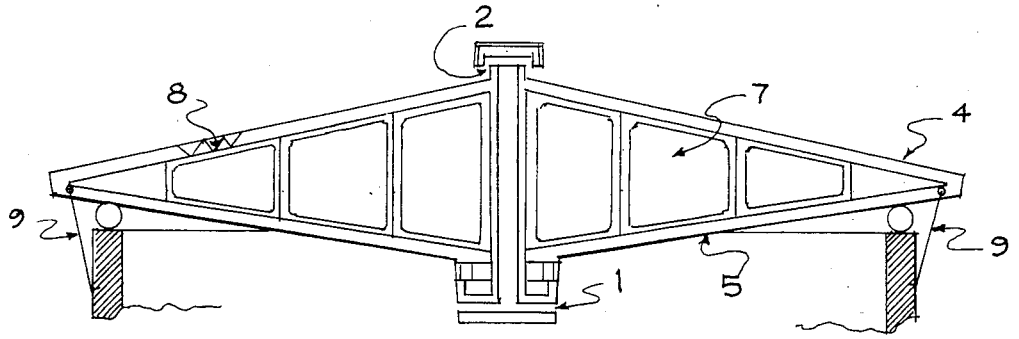
FIG. 4 is a vertical cross-sectional view through the roof in closed position on building, and taken along the structure line A—A on FIG. 2.
Figure 5:
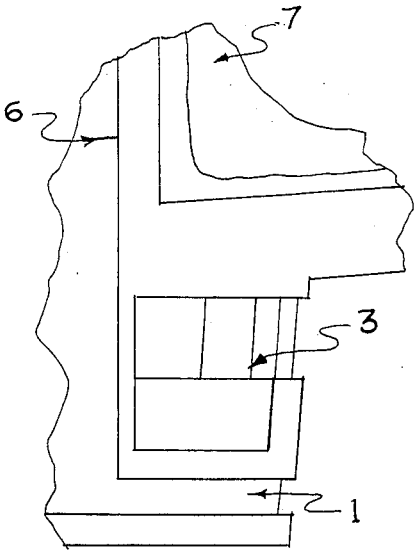
FIG. 5 is a fragmentary vertical cross-sectional view of the device, illustrating the "nacelle" around the core which serves for circulation of the air to the top outlet.
Figure 6:
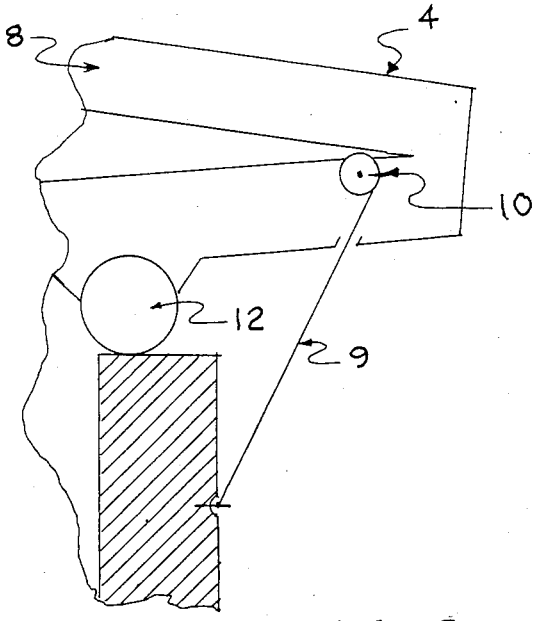
FIG. 6 is a fragmentary cross-sectional view showing the border of the roof with the location of the winches and the contact point to the building.

Frames 8 of this roof will be a very light and it will be covered on the top with a thin sheet of metal (foil) 4 or synthetic canvas 5 as well as underneath. The mooring cables 9 will be actioned by electric winches 10 shown on FIG. 6 and fixed inside the roof at the border, and controlled from the "nacelle" 3 shown on FIG. 5. This "nacelle" will be fixed at the bottom center of the roof as shown on FIG. 1, in order to facilitate the control of the roof mobility in the air. The motors 11 will be fixed under the roof as positioned on FIG. 1 and FIG. 2. The lifting movements of the roof is actioned by many small balloons 7 filled with helium gas, and placed around a central core 6 which form a tube where the ventilation (1 to 2) will pass and where the frame 8 (trusses) will be fixed. When the roof will be in closed position, the contact point between the underside of the shell and the upper part of the building wall will be secured by a continuous tube of helium 12 which assumed the contour of the roof, in accordance with the building (existing or new).

The embodiment of invention in which an exclusive property of privilege is claimed, is defined as follows;

1. A self-supporting, self-lifting, mobile and totally removable roof for covering building structures, comprising a very light structure and a thin covering forming a shell having a predetermined shape, a plurality of small balloons filled with helium gas disposed within said shell, said roof including a means of propulsion and a piloting cabin, whereby said balloons and said means of propulsion ensure, respectively, self-lifting and mobility of said roof so that said roof may be disposed on the building structure.

* * * * *